US005391239A

United States Patent [19]

Boulos

[11] Patent Number: 5,391,239

[45] Date of Patent: Feb. 21, 1995

[54] CONVERSION COATING OF ALUMINUM AND ITS ALLOYS AND COMPOSITIONS AND CONCENTRATES THEREFOR

[75] Inventor: Mervet S. Boulos, Troy, Mich.

[73] Assignee: Henkel Corporation, Plymouth Meeting, Pa.

[21] Appl. No.: 146,242

[22] Filed: Nov. 1, 1993

[51] Int. Cl.[6] ..... C23C 22/36

[52] U.S. Cl. ..... 148/253; 148/259; 148/275

[58] Field of Search ..... 148/275, 259; 428/472.2, 253

[56] References Cited

FOREIGN PATENT DOCUMENTS 0158287 4/1984 European Pat. Off. .
0038388 3/1984 Japan .
0113199 6/1984 Japan ..... 148/275

*Primary Examiner*—Sam Silverberg
*Attorney, Agent, or Firm*—Ernest G. Szoke; Wayne C. Jaeschke; Norvell E. Wisdom, Jr.

[57] ABSTRACT

Conversion coatings containing elpasolite and/or cryolite can be formed on aluminum substrates by contacting the substrates with an aqueous liquid composition containing adequate free fluoride ion activity and concentrations of dissolved sodium and potassium, if a potassium content in the coating is desired as is usual. The aqueous liquids preferably also contain phosphate and polyhydroxy organic compounds and may contain surfactants if a cleaning effect is desired.

19 Claims, No Drawings

CONVERSION COATING OF ALUMINUM AND ITS ALLOYS AND COMPOSITIONS AND CONCENTRATES THEREFOR

BACKGROUND OF THE INVENTION

1. Field of the Invention

This invention relates to compositions and processes for forming conversion coatings of novel composition on the surfaces of aluminum and those of its alloys that contain at least 45% by weight, preferably at least 75% by weight, or more preferably at least 90% by weight, of aluminum. The novel conversion coating, particularly when followed by a particular type of organic post-treatment known per se, provides excellent corrosion resistance and adhesion to subsequently applied paints and like protective outer coatings.

2. Statement of Related Art

Conversion coating of aluminum and its alloys generally is well known in the art. Most known and widely used conversion coating processes produce predominantly phosphate and/or chromate microcrystals in the coating, and the coatings contain predominantly divalent or higher valent cations and little or no fluoride or alkali metal ions. If the coatings are predominantly phosphate based, pretreatment with a colloidal titanium phosphate (Jernstedt salt) containing composition is generally required for best results, and the conversion coating composition itself generally contains an accelerator such as nitrite, nitrate, hydroxylamine or one of its derivatives, nitroorganic compounds, chlorate, or the like. These accelerators are often unstable, especially when combined with the other components of a conversion coating composition, so that multiple concentrate packages are often required to furnish all the needed ingredients (other than water) of a complete conversion coating composition, which is sometimes hereinafter called a "bath" for brevity, even though the composition may be satisfactorily brought into contact with the metal to be treated by spraying or other methods as well as by immersion.

Furthermore, for commercially acceptable corrosion resistance in some types of service, phosphate conversion coated metal must be post treated with compositions containing hexavalent chromium in order to "seal" the coating and improve its corrosion resistance. If the conversion coatings themselves are chromate based, the liquid compositions used to form the conversion coatings also normally contain hexavalent chromium, which is now notorious for its pollution of the environment and probable carcinogenicity, and therefore generally may not be legally disposed of without costly pretreatment.

DESCRIPTION OF THE INVENTION

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, unless expressly stated to the contrary: percent, "parts of", and ratio values are by weight; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; specification of materials in ionic form implies the presence of sufficient counterions to produce electrical neutrality for the composition as a whole; any counterions thus implicitly specified should preferably be selected from among other constituents explicitly specified in ionic form, to the extent possible; otherwise such counterions may be freely selected, except for avoiding counterions that act adversely to the objects of the invention; the term "mole" may be applied to ionic and elemental as well as molecular constituents; and the term "polymer" includes "oligomer".

OBJECTS OF THE INVENTION

One object of the invention is to provide a conversion coating treatment for aluminum that promotes excellent corrosion resistance when used as an undercoating for paint and similar conventional outermost protective coating materials, which consist essentially of organic binder and, optionally but usually, fillers and/or coloring materials. In many embodiments, another object is to provide a complete coating process that does not require hexavalent chromium at any stage. Another object of some embodiments of the invention is to provide a highly stable single package concentrate that may be diluted at the point of use with water only to provide a complete conversion coating bath. In some embodiments, another object of this invention is to combine cleaning and conversion coating of an aluminum surface. Other objects will be apparent from the description below.

SUMMARY OF THE INVENTION

It has been found that conversion coatings containing substantial amounts of hexafluoroaluminate ions and of sodium and, optionally, potassium ions, as evidenced by the presence of X-ray diffraction patterns characteristic of salts having the composition $K_xNa_{(3-x)}AlF_6$, where x is a number between 0 and 2 inclusive, provide good quality undercoatings. Such conversion coatings can be formed on aluminum substrates by contacting the substrates with aqueous liquid compositions that have a pH value within the range from 3.0 to 4.8, or with increasing preference in the order given, within a range from 3.5 to 4.8, 3.7 to 4.7, 3.9 to 4.6, 4.1 to 4.5, or 4.2 to 4.4 and that comprise, preferably consist essentially of, or more preferably consist of, water and:

(A) free fluoride activity; and
(B) sodium ions; and, optionally but preferably,
(C) phosphate ions; and, optionally but preferably
(D) a component selected from polyhydroxy organic molecules containing from 3 to 12 carbon atoms and at least two thirds as many hydroxyl groups, exclusive of those that are part of carboxyl groups, as carbon atoms; and, optionally but preferably,
(E) potassium ions; and, optionally but preferably, if a cleaning effect as well as a conversion coating formation is desired,
(F) surfactants; and, optionally,
(G) ferrous ions; and, optionally,
(H) aluminum cations; and, optionally,
(J) a source of hydroxylamine and/or nitroorganic compounds with oxidizing power.

The conversion coatings according to the invention have sufficient adhesion to the underlying aluminous substrate that they can not be stripped from the substrate by applying conventional adhesive tape firmly to the conversion coated metal surface and then peeling off the tape.

The presence of free fluoride as required above is defined and can conveniently be quantified by means of a fluoride ion sensitive electrode (often abbreviated hereinafter as "FISE"). Such electrodes are known to those skilled in the art and are readily available commercially; one suitable such electrode is described in U.S. Pat. No. 3,431,182. The "free fluoride activity" as this term is used herein was measured by comparison against a pH buffered standard solution. (The pH buffer, at an alkaline pH value, is needed to assure substantially complete conversion of any $HF_2^-$ ions present to free fluoride ions.)

To determine the free fluoride activity in a composition according to the invention, the difference in electrical potential between a FISE and a reference electrode is measured first in the standard solution and then in a sample of the composition for which the free fluoride activity is to be determined, after the sample of this composition has been buffered to the same pH as the standard solution and, if necessary, brought to the same temperature as used for the standard solution. The difference in electrical potential thus measured, usually expressed in millivolts (hereinafter often abbreviated "mv" or "mV"), can be converted to free fluoride activity values, which are usually expressed in parts per million (hereinafter often abbreviated "ppm"), by mathematical calculations known to those skilled in the art, or by use of calibrations supplied with commercial FISE's and/or suitable voltmeters for use with FISE's.

The term "phosphate ions" as used above and hereinafter after this paragraph is, unless explicitly qualified to the contrary, to be understood as including the stoichiometric equivalent as $PO_4^{-3}$ ions of the total of all the simple and condensed phosphoric acids and their salts of any degree of neutralization and ionization that are present in solution in the compositions according to the invention.

It should be understood that the various components identified by letters above need not necessarily all be supplied from distinct chemical sources. For example, the preferred source of phosphate ions is generally commercial concentrated phosphoric acid, which supplies at least part of the acidity required to achieve the specified pH values along with phosphate ions.

As already briefly noted, one of the characteristics of most conversion coatings according to this invention is their crystallinity, as evidenced by their ability to diffract X-rays in a manner characteristic of alkali metal hexafluoroaluminate salts. For example, elpasolite in its most common form has the chemical formula $K_2NaAlF_6$ and exhibits X-ray diffraction peaks with Cu-$\alpha$ radiation having local peak intensities at particular lattice spacings as shown in Table 1 below. Spacings are in Ångstrom units, abbreviated "Å" and equal to $10^{-10}$ meters. For elpasolite and cryolite, the listings are in order of decreasing intensity, while for aluminum the listings are of all the prominent peaks in the range from 1 to 4 Å, in order of increasing spacing. As can be seen from Table 1, six of the eight most prominent X-ray diffraction peaks in the spectrum of elpasolite substantially overlap peaks from aluminum metal, which will normally be more prominent in any X-ray spectrum of the conversion coating formed on an aluminum substrate. However, the elpasolite peaks at spacings of 4.688 Å and 2.872 Å, which have relative intensities in the ratio of 0.9:2.3, are free from this difficulty and serve as effective identifiers of one type of coating according to this invention. For cryolite, the most prominent peaks have little or no overlap with the aluminum peaks, so that detection of this crystal pattern in conversion coatings according to this invention is relatively easy.

TABLE 1

X-RAY DIFFRACTION DATA FOR ALUMINUM, ELPASOLITE, AND CRYOLITE

| Spacing in Å of Prominent Diffraction Peaks for: | | |
|---|---|---|
| Aluminum | Elpasolite | Cryolite |
| 1.169 | 2.338 | 2.75 |
| 1.221 | 2.026 | 1.94 |
| 1.430 | 1.432 | 2.89 |
| 2.026 | 1.221 | |
| 2.338 | 1.169 | |
| | 2.872 | |
| | 1.217 | |
| | 4.688 | |

Various embodiments of the invention include processes for producing one of the above described types of crystalline conversion coatings, working compositions suitable for direct use in treating metals to produce such conversion coatings, concentrates from which such working compositions can be prepared by dilution with water, processes for treating metals with a composition according to the invention, and extended processes including additional steps that are conventional per se, such as precleaning, rinsing, posttreatments, and subsequent painting or some similar overcoating process that puts into place an organic binder containing protective coating over the metal surface treated according to a narrower embodiment of the invention. Articles of manufacture including surfaces treated according to a process of the invention, or any aluminum substrate with an adherent outer coating showing the crystal pattern of elpasolite and/or cyrolite, are also within the scope of the invention.

DESCRIPTION OF PREFERRED EMBODIMENTS

The free fluoride activity for working solutions preferably is within the range from 200 to 5000 ppm, or, with increasing preference in the order given, is in the range from 500 to 2000, 550 to 1700, 600 to 1400, 650 to 1100, or 700 to 1000, ppm.

The free fluoride activity may be provided by use of any of a wide variety of salts or other compounds in the compositions according to the invention. Preferably, the free fluoride activity is provided by use of one or more of hydrofluoric acid, ammonium and alkali metal fluorides and acid fluorides, and fluoboric, fluosilicic, fluotitanic, and fluozirconic acids and their ammonium and alkali metal salts. More preferably the free fluoride is provided by a combination of solutes that includes both (A.1) fluorine from anions containing no other elements than fluorine and hydrogen, such as those from hydrofluoric acid and from the fluoride and acid fluoride salts of the alkali metals and ammonia, and also (A.2) fluorine from anions containing at least one element other than fluorine and hydrogen, such as fluoborate, fluosilicate, fluotitanate, and fluozirconate anions. Still more preferably, the ratio of fluorine atoms from component (A.1) to those from component (A.2) is within the range from 1:5 to 20:1, or, with increasing preference in the order given, from 1.0:2.5 to 5.0:0.5, 1.0:2.0 to 8.0:1.0, 0.75:1.0 to 4.5:1.0, 1.0:1.0 to 3.0:1.0, 1.50:1.0 to 2.50:1.0, 1.80:1.0 to 2.20:1.0, or 1.90:1.0 to 2.10:1.00. Most preferably, component (A.1) is derived from ammonium acid fluoride (i.e., $NH_4F.HF$) and component (A.2) from fluoboric acid (i.e., $HBF_4$).

Independently, in a working composition according to the invention the total concentration of fluorine from all sources, as measured by chemical analysis rather than electrode potentials as described above for determining free fluoride activity, is preferably within the range from 0.01 to 1.0%, or with increasing preference in the order given, within the range from 0.02 to 0.8, 0.04 to 0.6, 0.05 to 0.40, 0.06 to 0.30, 0.07 to 0.25, 0.08 to 0.22, 0.09 to 0.18, 0.090 to 0.160, or 0.105 to 0.145,%.

The total concentration of component (B), i.e., sodium ions, in a working composition according to this invention preferably is, with increasing preference in the order given, within the range from 0.02 to 2.2%, 0.04 to 1.7, 0.09 to 1.3, 0.11 to 0.86, 0.13 to 0.64, 0.15 to 0.54, 0.17 to 0.47, 0.19 to 0.39, 0.190 to 0.34, or 0.225 to 0.312,%. Independently, the ratio of component (B) to the total fluorine content of a composition according to this invention preferably is, with increasing preference in the order given, within the range from 0.5:1 to 5.0:1, 1.0:1 to 3.0:1, 1.3:1.0 to 2.9:1.0, 1.6:1.0 to 2.6:1.0, 1.85:1.00 to 2.45:1.00, 2.00:1.00 to 2.30:1.00, or 2.10:1.00 to 2.20:1.00.

Higher quality coatings normally appear to be formed when phosphate ions are present in a coating composition according to the invention, so that the presence of such ions is preferred. The preferred source of phosphate ions for the compositions according to the invention that contain these ions is ordinary orthophosphoric acid with the chemical formula $H_3PO_4$ or one of its alkali metal salts, but pyrophosphoric acid, tripolyphosphoric acid, and other condensed phosphoric acids, along with metaphosphoric acid and salts of any of these acids can also be used. Ordinarily, the readily commercially available aqueous orthophosphoric acid containing about 75% of the pure acid is the most preferred source, because it is usually most economical and at least as technically effective as other sources. Preferably, in a working composition according to the invention, the concentration of phosphorus from component (C) is not greater than 5%, or, with increasing preference in the order given, is within the range from 0.02 to 3.5, 0.05 to 2.0, 0.10 to 1.2, 0.25 to 0.90, 0.50 to 0.75, or 0.60 to 0.66,%. Independently, with increasing preference in the order given, the ratio of the concentration of phosphorus from component (C) to the concentration of total fluoride from component (A) in a working composition according to the invention is not greater than 20:1, or, with increasing preference in the order given, is within the range from 0.5:1 to 15.0:1, 1.0:1 to 10:1, 2.0:1.0 to 8.0:1.0, 3.0:1.0 to 7.0:1.0, or 4.0:1.0 to 6.0:1.00.

Component (D) when present in coating compositions according to this invention also appears to promote higher quality coatings, although no reason for this effect is known. The materials suitable for component (D) are independently known to be capable of complexing aluminum and other polyvalent metal ions, and this property may be useful in modifying the concentrations of constituents of the coating baths according to the invention in the immediate vicinity of the surfaces being coated. In any case, component (D) when used is preferably selected from molecules having from 3 to 7 carbon atoms arranged in a straight chain, with one hydroxyl on each of the carbon atoms except possibly on one of the terminal carbon atoms, more preferably from gluconic and heptogluconic acids and their salts, most preferably gluconic acid. In a composition according to the invention, the ratio of the concentration of component (D) to the total fluorine content from component (A) preferably is, with increasing preference in the order given, 0.07:1.0 to 1.6:1.0, 0.15:1.0 to 1.2:1.0, 0.30:1.0 to 0.90:1.0, 0.50:1.0 to 0.70:1.0, or 0.55:1.00 to 0.65:1.0. Independently, the concentration of component (D) in a working composition according to the invention preferably is, with increasing preference in the order given, within the range from 0.012 to 0.48, 0.024 to 0.36, 0.030 to 0.24, 0.036 to 0.18, 0.042 to 0.15, 0.048 to 0.14, 0.054 to 0.12, 0.054 to 0.096, or 0.065 to 0.088,%.

The presence of component (E), i.e., potassium ions, in compositions according to the invention is often preferred, inasmuch as the elpasolite coatings according to the invention appear to have somewhat more consistent properties than the coatings according to the invention that are formed in the absence of potassium. When present in a working composition according to the invention, the concentration of component (E) preferably is not greater than 10%, or, with increasing preference in the order given, within the range from 0.03 to 3.3%, 0.06 to 2.6, 0.14 to 2.0, 0.17 to 1.30, 0.20 to 0.97, 0.23 to 0.82, 0.26 to 0.71, 0.30 to 0.61, 0.29 to 0.53, or 0.35 to 0.49,%. Independently, the ratio of component (E) to the total fluoride preferably is, with increasing preference in the order given, within the range from 0.8:1 to 7.6:1, 1.6:1 to 4.8:1, 2.0:1.0 to 4.6:1.0, 2.5:1.0 to 4.1:1.0, 2.9:1.00 to 3.8:1.00, 3.14:1.00 to 3.61:1.00, or 3.30:1.00 to 3.45:1.00.

Preferred chemical types for component (F) are polyethoxylated alcohols with about 12–22 carbon atoms, other modified polyethers of the aliphatic or aromatic types, and salts of complex organic phosphate esters. More preferably component (F) contains both an anionic suffactant salt of a complex organic phosphate ester and of an octyl- or nonyl-phenol ethoxylate nonionic surfactant, with the ratio of the anionic to the nonionic surfactant in the range from 0.1:1.0 to 10:1.0, 0.5:1.0 to 3.6:1.0, 1.0:1.0 to 1.8:1.0, 1.3:1.0 to 1.5:1.0, or 1.35:1.00 to 1.45:1.00. Independently, the concentration of component (F) in a working composition according to the invention preferably is, with increasing preference in the order given, within the range from 0.007 to 0.29, 0.014 to 0.22, 0.02 to 0.14, 0.022 to 0.11, 0.025 to 0.09, 0.029 to 0.084, 0.032 to 0.072, 0.032 to 0.058, or 0.039 to 0.053,%.

When mild steel is used as a container vessel, rack material, or in any other part of the structure in which a process according to the invention is performed, iron is likely to dissolve into the conversion coating bath if it is initially free of iron. In such cases, component (G) is preferably used in the bath compositions according to this invention, in order to stabilize the performance of the composition from the beginning of its use and retard further dissolution of iron. In addition, under some conditions of operation, component (G) promotes desirably higher coating masses per unit area of the surface coated and may be preferred for that reason even if there is no source of iron exposed to the coating bath. When present, the amount of component (G) preferably is, with increasing preference in the order given, within the range from 0.0003 to 0.012, 0.0006 to 0.009, 0.0008 to 0.006, 0.0009 to 0.0045, 0.0012 to 0.0038, 0.0012 to 0.0035, 0.0013 to 0.0030, 0.0014 to 0.0024, or 0.0016 to 0.0022,%.

Optional component (H) is one that is tolerable but not particularly advantageous. In general, in conversion coating of aluminum, it has been observed that aluminum ions accumulate in the conversion coating composition, presumably by dissolution from the aluminum substrate. Such accumulation appears to be less with compositions according to this invention than with most prior art conversion coatings, but accumulation of aluminum in the baths may nevertheless occur, particularly with very prolonged use. It has therefore been determined that concentrations of aluminum ions up to 0.1% by weight cause no evident harm to the conversion coatings formed when present in compositions according to this invention.

The primary purpose of optional component (J) is to reduce corrosion of mild steel containers, pipework, and the like with which the liquid compositions according to the invention may come into contact. This component is not believed to have any significant effect on the conversion coatings formed, contrary to conventional expectations for conversion coatings that contain primarily phosphate as the anions in the coatings. The most preferred material for component (J) is hydroxylamine sulfate, a relatively stable source of dissolved hydroxylamine in aqueous solution, and a concentration of 0.5 to 5% in a working composition will generally achieve adequate corrosion protection.

"Points" of total acid for the purpose of the description herein are defined as equal to the number of milliliters ("mL") of 0.1N strong alkali (such as sodium hydroxide) required to titrate a 10.0 mL sample of the composition, diluted with deionized water containing a large excess of fluoride ions to prevent precipitation of any heavy metal hydroxides during titration, to an end point with phenolphthalein indicator. Working compositions according to this invention preferably have, with increasing preference in the order given, from 4 to 34, 8 to 30, 12 to 26, 15 to 23, or 17 to 21, points of total acid.

For a variety of reasons, it is often preferred that compositions according to the invention as defined above should be substantially free from many ingredients used in compositions for similar purposes in the prior art. Specifically, often it is increasingly preferred in the order given, independently for each preferably minimized component listed below, that these compositions, when directly contacted with metal in a process according to this invention, contain no more than 1.0, 0.35, 0.10, 0.08, 0.04, 0.02, 0.01, 0.001, or 0.0002, percent of each of the following constituents: nitrite; chloride, bromide, or iodide anions; hexavalent chromium; manganese in a valence state of four or greater; manganese, nickel, cobalt, zinc, calcium, magnesium, and copper cations in a valence state of 2; peroxy compounds, ferricyanide, ferrocyanide, and pyrazole compounds.

A concentrate according to the invention preferably contains all the same ingredients as described above, except water and component (J), in amounts from 2 to 200, more preferably from 5 to 100, still more preferably from 10 to 50, times the concentrations given above. Thus a concentrate can be diluted with water only to make a working composition according to this invention. Although hydroxylamine sulfate in particular and some of the other materials suitable for component (J) can be added to concentrates, it is generally preferred to add component (J) when it is used to working compositions only shortly before use, because some of the materials suitable for this component are somewhat unstable chemically in the presence of the other components, particularly in the high concentrations that are economical in concentrates. Furthermore, users who do not have any danger of iron corrosion in their operations may, for economic reasons, prefer concentrates formulated without these relatively expensive ingredients.

In a process according to the invention, contact between the metal surface to be treated and a composition according to the invention may be accomplished by spraying, dipping, or any other convenient method or combination of methods. The temperature during contact between the metal treated and the composition according to the invention preferably is, with increasing preference in the order given, in the range from 21° to 85°, 25° to 70°, or 30° to 65,° C. The time of contact preferably is, with increasing preference in the order given, in the range from 5 sec to 15 minutes (hereinafter "min"), 15 sec to 10 min, 30 sec to 5 min, 45 sec to 3.0 min, or 50 sec to 100 sec. The add-on mass of the coating formed per unit area of surface coated preferably is, with increasing preference in the order given, in the range from 200 to 5000, 500 to 4500, or 1000 to 2700, milligrams per square meter (hereinafter "$mg/m^2$) of surface treated. Preferred coatings according to the invention show nodular crystallinity in scanning electron microscope examination of the coated surfaces.

After contact between the composition according to the invention and formation of the conversion coating, the surface of the latter is preferably rinsed with water, at least the last of such rinses preferably being with distilled or deionized water, and then is preferably treated with a composition according to the teachings of U.S. Pat. No. 4,963,596 and then again rinsed with water and dried, before being preferably coated with a conventional paint or like material. Prior to contact of the aluminum surface to be treated with a composition according to this invention, the surface is preferably freed from any visible contamination and, particularly if the composition according to the invention that is to be used does not contain any surfactant component, may often advantageously be chemically cleaned and, optionally, desmutted by any method conventional for the type of aluminum to be treated before other types of conversion coatings are applied thereto.

The practice of this invention may be further appreciated by consideration of the following, non-limiting, working examples.

EXAMPLES GROUP 1

In the examples in this group, coatings with an X-ray diffraction pattern indicative of elpasolite were formed.

Concentrate Compositions

Some preferred concentrate compositions are shown in Table 2 below.

Working Compositions and Processes and Comparisons

Concentrate Composition 2 as shown in Table 2 was diluted with deionized water to provide a composition containing 4.8% of the concentrate, with a total acid value of 17 to 21 points, a pH value of 4.2 to 4.4, and a free fluoride activity of 690 to 750 ppm. Panels of Types 6061 and 6063 aluminum were subjected to the following process sequence:

TABLE 2

COMPOSITIONS OF CONCENTRATES

TABLE 2-continued

ACCORDING TO THE INVENTION

| Ingredient | Parts by Weight[1] of Inqredient in Composition Number: 1 | 2 | 3 |
|---|---|---|---|
| Aqueous phosphoric acid (75% $H_3PO_4$) | 450 | 513 | 513 |
| Aqueous fluoboric acid (49% $HBF_4$) | 12 | 19 | 20 |
| Ammonium acid fluoride | 25 | 24.5 | 25 |
| Gluconic acid | | 20 | 20 |
| Aqueous KOH solution (45% KOH) | 280[2] | 300[2] | 300[2] |
| Aqueous NaOH solution (50% NaOH) | 55[2] | 55[2] | 55[2] |
| TRITON TM X-100 (Octyl phenol ethoxylate nonionic surfactant) | 5 | 5 | 5 |
| TRITON TM H-66 (Salt of a complex organic phosphate ester anionic surfactant) | 7 | 7 | 7 |
| $FeSO_4$ | 0.5 | 0.5 | 0.5 |

[1]Unless otherwise noted.

[2]These values were by volume rather than mass, with the numbers shown in the table corresponding to milliliters when the numbers shown for the other constituents correspond to grams.

1. Spray for 60 sec at 60° C. with a solution of 1% RIDOLINE TM 34 in water.
2. Rinse with warm tap water for 30 sec.
3. Immerse for 5 min at ambient temperature (about 24° C.) in P3-Almeco TM D-90.
4. Spray rinse in tap water at ambient temperature for 30 sec.
5. (According to the invention) Spray for 70 sec with the working solution according to the invention as described above at 49° C.

5'. (Not according to the invention) Spray for 30 sec with a composition prepared according to the manufacturer's directions from ALODINE TM 407 and 47, adjusted to pH 4.3 and 16.5%, at 49° C.

6. Rinse with tap water at ambient temperature for 30 sec.

6A. (According to the invention only) Immerse for 30 sec in a composition prepared according to the directions of column 11 lines 39-52 of U.S. Patent 4,963,596.

7. Spray rinse for 15 sec with deionized water at ambient temperature.
8. Dry in oven at 103° C. for 5 min.
9. Paint with PPG TM UC-51044 BRONZ paint, according to manufacturer's directions.

(The RIDOLINE TM, P3-Almeco TM, and ALODINE TM products noted above are all available commercially from the Parker+Amchem Div. of Henkel Corp., Madison Heights, Michigan; the paint is available from PPG Corp.)

In all instances, the panels processed according to the invention were at least as, and often more, resistant to peeling of the applied paint, either as applied or after 20 minutes immersion in boiling water.

EXAMPLES AND COMPARISON EXAMPLES GROUP 2

In these examples, the coating formed had X-ray diffraction patterns and other indica of containing cryolite and/or elpasolite. The working example was made with a concentrate like that of Composition 2 in Group 1, except that the potassium content was omitted. Additional ammonium acid fluoride was added to the working solution as needed to achieve various levels of free fluoride activity. At 300 ppm free fluoride, only a smutted coating formed, but at 600 and 900 ppm of free fluoride, an adherent nodular crystalline conversion coating was obtained.

The invention claimed is:

1. A process of forming on a substrate of aluminum or an aluminum alloy containing at least about 45% by weight of aluminum an adherent conversion coating that exhibits X-ray diffraction peaks characteristic of crystalline alkali metal hexafluoroaluminates of a composition according to the formula $K_xNa_{(3-x)}AlF_6$, where x is a number between 0 and 2 inclusive, said conversion coating being formed by spontaneous chemical reaction upon contacting the substrate with an aqueous liquid composition for a time of not more than 10 minutes at a temperature of not more than 85° C., said aqueous liquid composition having a pH from about 3.0 to about 4.8 and consisting essentially of water and;

(A) from about 200 to about 5000 ppm of free fluoride;

(B) from about 0,02 to about 2.2% of sodium ions; and (C) from about 0.02 to about 3.5% of phosphate ions.

2. A process according to claim 1, wherein the aqueous liquid composition consists essentially of water and:

(A) free fluoride (B) sodium ions; and, (C) phosphate ions; and, optionally, one or more of;

(D) a component selected from polyhydroxy organic molecules containing from 3 to 12 carbon atoms and at least two thirds as many hydroxyl groups, exclusive of those that are part of carboxyl groups, as carbon atoms;

(E) potassium ions;

(F) surfactants;

(G) ferrous ions;

(H) aluminum cations; and (J) a source of hydroxylamine or nitroorganic compounds with oxidizing power.

3. A process according to claim 2, wherein the aqueous liquid composition has a pH value within the range from about 3.5 to about 4.8 and from about 4 to about 34 points of total acid and consists essentially of water and;

(A) from about 500 to about 2000 ppm of free fluoride ions;

(B) from about 0.11 to about 0.86% of sodium ions; and (C) from about 0.10 to about 1.2% of phosphorus from phosphate ions; and, optionally, one or more of;

(D) from about 0.012 to about 0.48% of a component selected from polyhydroxy organic molecules containing from 3 to 12 carbon atoms and at least two thirds as many hydroxyl groups, exclusive of those that are part of carboxyl groups, as carbon atoms;

(E) from about 0.03 to about 3.3% of potassium ions;

(F) from about 0.007 to about 0.29% of surfactants;

(G) up to about 0.012% of ferrous ions;

(H) up to 0.1% of aluminum cations; and (J) up to 5% of a source of hydroxylamine or nitroorganic compounds with oxidizing power.

4. A process according to claim 3, wherein the aqueous liquid composition has a pH value within the range from 4.1 to 4.5 and from about 15 to about 23 points of total acid and consists essentially of water and:

(A) a total fluorine content within the range from about 0.090 to about 0.160% that provides from about 700 to about 1000 ppm of free fluoride ions, said free fluoride content being supplied by solutes selected from both the groups consisting of (A.1) anions containing no other elements than fluorine and hydrogen and (A.2) anions containing fluorine and another element exclusive of hydrogen, in amounts such that the ratio of group (A.1) to group (A.2) is within the range from about 1.50:1.0 to 2.5:1.0; and (B) from about 0.190 to about 0.34% of sodium ions;

(C) from about 0.25 to about 0.90% of phosphorus from phosphate ions;

(D) from about 0.054 to about 0.096% of material selected from the group consisting of gluconic and heptogluconic acids and their salts;

(E) from about 0.29 to about 0.53% of potassium ions; and (F) from about 0.032 to about 0.058% of total surfactants, including anionic surfactant and nonionic surfactant in a ratio within the range from about 1.3:1.00 to about 1.5:1.00; and, optionally, (G) from about 0.0012 about 0.0035% of ferrous ions; and, optionally, (H) up to 0.1% of aluminum cations; and, optionally, (J) up to 5% of a source of hydroxylamine or nitroorganic compounds with oxidizing power.

5. A process according to claim 4, wherein the aqueous liquid composition has a pH value within the range from 4.2 to 4.4 and from about 17 to about 21 points of total acid and consists essentially of water and:

(A) a total fluorine content within the range from about 0.105 to about 0.145% that provides from about 700 to about 1000 ppm of free fluoride ions, said free fluoride content being supplied by dissolved ammonium acid fluoride and dissolved fluoboric acid in a ratio of ammonium acid fluoride to fluoboric acid within the range from about 1.80:1.0 to 2.20:1.0; and (B) from about 0.225 to about 0.312% of sodium ions;

(C) from about 0.60 to about 0.66% of phosphorus from phosphate ions;

(D) from about 0.065 to about 0.088% of gluconic acid;

(E) from about 0.35 to about 0.49% of potassium ions; and (F) from about 0.039 to about 0.053% of total surfactants, including anionic partial phosphate ester surfactant and nonionic octyl- or nonyl-phenol ethoxylate surfactant in a ratio within the range from about 1.35:1.00 to about 1.45:1.00; and, optionally, (G) from about 0.0016 about 0.0022% of ferrous ions; and, optionally, (H) up to 0.1% of aluminum cations; and, optionally, (J) up to 5% of a source of hydroxylamine or nitroorganic compounds with oxidizing power.

6. An aqueous liquid composition of matter that is suitable, either as such or after dilution with water, to form on aluminum and aluminum alloy substrates an adherent conversion coating that exhibits X-ray diffraction peaks characteristic of crystalline alkali metal hexafluoroaluminates of a composition according to the formula $K_xNa_{(3-x)}AlF_6$, where x is a number between 0 and 2 inclusive, said aqueous liquid composition consisting essentially of water and:

(A) a total fluorine content providing free fluoride ions;

(B) an amount of sodium ions such that the ratio of sodium ions to the total fluorine content is within the range from about 0.5:1 to about 5.0:1;

(C) an amount of phosphate ions such that the ratio of phosphorus content of the phosphate ions to the total fluorine content is within the range from about 0.5:1 to about 15.0:1; and (D) a component selected from polyhydroxy organic molecules containing from 3 to 12 carbon atoms and at least two thirds as many hydroxyl groups, exclusive of those that are part of carboxyl groups, as carbon atoms, in an amount such that the ratio of component (D) to the total fluorine content is within the range from about 0.07:1 to about 1.6:1; and, optionally, (E) an amount of potassium ions such that the ratio of the potassium ions to the total fluorine content is within the range from about 0.8:1 to about 7.6:1.0; and, optionally, (F) surfactants; and, optionally, (G) ferrous ions; and, optionally, (H) aluminum cations; and, optionally, a source of hydroxylamine or nitroorganic compounds with oxidizing power.

7. An aqueous liquid composition according to claim 6, wherein the ratio of sodium ions to the total fluorine content is within the range from about 1.3:1.0 to about 2.9:1.0, the ratio of phosphorus content of the phosphate ions to the total fluorine content is within the range from about 2.0:1.0 to about 8.0:1.0; the ratio of component (D) to the total fluorine content is within the range from about 0.15:1.0 to about 1.2:1.0, and if potassium ions are present, the ratio of the potassium ions to the total fluorine content is within the range from about 2.0:1.0 to about 4.6:1.0.

8. An aqueous liquid composition according to claim 7, wherein the total fluorine content includes solutes selected from both (A.1) the group consisting of sources of anions containing no other elements than fluorine and hydrogen and (A.2) the group consisting of sources of anions containing fluorine and another element exclusive of hydrogen, in amounts such that the ratio of group (A.1) to group (A.2) is within the range from about 1.0:1.0 to about 3.0:1.0; the ratio of sodium ions to the total fluorine content is within the range from about 1.6:1.0 to about 2.6:1.0; the ratio of phosphorus content of the phosphate ions to the total fluorine content is within the range from about 3.0:1.0 to about 7.0:1.0; the ratio of component (D) to the total fluorine content is within the range from about 0.30:1.0 to about 0.90:1; and the ratio of potassium ions to the total fluorine content is within the range from about 2.0:1.0 to about 4.6:1.0.

9. An aqueous liquid composition according to claim 8, wherein the total fluorine content includes solutes selected from both (A.1) the group consisting of hydrofluoric acid and the alkali metal and ammonium fluorides and acid fluorides and (A.2) the group consisting of fluoboric, fluozirconic, fluotitanic, and fluosilicic acids and their soluble salts, in amounts such that the ratio of group (A.1) to group (A.2) is within the range from about 1.5:1.0 to about 2.5:1.0; the ratio of sodium ions to the total fluorine content is within the range from about 1.85:1.0 to about 2.45:1.0; the ratio of phosphorus content of the phosphate ions to the total fluorine content is within the range from about 3.0:1.0 to about 7.0:1.0; the ratio of component (D) to the total fluorine content is within the range from about 0.30:1.0 to about 0.90:1; and the ratio of potassium ions to the total fluorine content is within the range from about 2.9:1.0 to about 3.8:1.0.

10. An aqueous liquid composition according to claim 9, wherein the total fluorine content includes both (A.1) ammonium acid fluoride and (A.2) fluoboric acid, in amounts such that the ratio of group (A.1) to group (A.2) is within the range from 1.8:1.0 to 2.2:1.0; the ratio of sodium ions to the total fluorine content is within the range from 2.00:1.0 to 2.30:1.0; the ratio of phosphorus content of the phosphate ions to the total fluorine content is within the range from 4.0:1.0 to 6.0:1.0; component (D) contain gluconic acid in such an amount that the ratio of gluconic acid to the total fluorine content is within the range from 0.50:1.0 to 0.70:1; the ratio of potassium ions to the total fluorine content is within the range from 3.14:1.0 to 3.61:1.0; an amount of at least 0.007% of component (F) is present and includes an anionic surfactant salt of a partial ester of phosphoric acid and an octyl- or nonyl-phenol ethoxylate nonionic surfactant in a ratio of anionic to nonionic surfactant within the range from 1.3:1.0 to 1.5:1.0; and an amount of at least 0.0009% of ferrous ions is present.

11. An aqueous liquid composition according to claim 10, wherein the composition has a pH value within the range from 4.2 to 4.4 and from about 17 to about 21 points of total acid; the total fluorine content is within the range from about 0.105 to about 0.145% and the free fluoride activity is within the range from about 700 to about 1000 ppm; the content of sodium ions is within the range from about 0.225 to about 0.312%; there is present from about 0.60 to about 0.66% of phosphorus from phosphate ions; there is present from about 0.065 to about 0.088% of gluconic acid; there is present from about 0.35 to about 0.49% of potassium ions; there is present from about 0.039 to about 0.053% of total surfactants; and there is present from about 0.0016 about 0.0022% of ferrous ions.

12. An aqueous liquid composition according to claim 8, wherein the composition has a pH value within the range from about 4.1 to about 4.5 and from about 15 to about 23 points of total acid; the total fluorine content is within the range from about 0.090 to about 0.16% and the free fluoride activity is within the range from about 650 to about 1100 ppm; the content of sodium ions is within the range from about 0.19 to about 0.34%; there is present from about 0.50 to about 0.75% of phosphorus from phosphate ions; there is present from about 0.054 to about 0.096% of component (D); there is present from about 0.29 to about 0.53% of potassium ions; and there is present from about 0.029 to about 0.084% of total surfactants.

13. An aqueous liquid composition according to claim 7, wherein the composition has a pH value within the range from about 3.9 to about 4.6 and from about 12 to about 26 points of total acid; the total fluorine content is within the range from about 0.07 to about 0.25% and the free fluoride activity is within the range from about 600 to about 1400 ppm; the content of sodium ions is within the range from about 0.17 to about 0.47%; there is present from about 0.25 to about 0.90% of phosphorus from phosphate ions; there is present from about 0.036 to about 0.18% of component (D); and there is present from about 0.23 to about 0.82% of potassium ions.

14. An aqueous liquid composition according to claim 6, wherein the composition has a pH value within the range from about 3.5 to about 4.8 and from about 8 to about 30 points of total acid; the total fluorine content is within the range from about 0.02 to about 0.8% and the free fluoride activity is within the range from about 550 to about 1700 ppm; the content of sodium ions is within the range from about 0.11 to about 0.86%; there is present from about 0.05 to about 2.0% of phosphorus from phosphate ions; there is present from about 0.024 to about 0.36% of component (D); and there is present not more than about 2.0% of potassium ions.

15. An aqueous liquid composition according to claim 5, wherein the composition has a pH value within the range from about 3.0 to about 4.8 and from about 4 to about 34 points of total acid; the total fluorine content is within the range from about 0.01 to about 1.0% and the free fluoride activity is within the range from about 500 to about 2000 ppm; the content of sodium ions is within the range from about 0.02 to about 2.2%; there is present from about 0.03 to about 3.3% of phosphorus from phosphate ions; there is present from about 0.012 to about 0.48% of component (D); and there is present not more than about 3.3% of potassium ions.

16. A process for forming a conversion coating on an aluminum or aluminum alloy substrate, comprising a step of contacting the substrate with an aqueous liquid composition according to claim 15.

17. A process for forming a conversion coating on an aluminum or aluminum alloy substrate, comprising a step of contacting the substrate with an aqueous liquid composition according to claim 13 for a time within the range from about 5 seconds to about 15 minutes at a temperature within the range from about 21° to about 85° C.

18. A process for forming a conversion coating on an aluminum or aluminum alloy substrate, comprising a step of contacting the substrate with an aqueous liquid composition according to claim 12 for a time within the range from about 30 seconds to about 5 minutes at a temperature within the range from about 25° to about 70° C.

19. A process for forming a conversion coating on an aluminum or aluminum alloy substrate, comprising a step of contacting the substrate with an aqueous liquid composition according to claim 11 for a time within the range from about 45 seconds to about 3.5 minutes at a temperature within the range from about 30° to about 65° C.

* * * * *